United States Patent [19]

Hirabayashi et al.

[11] Patent Number: 4,562,143

[45] Date of Patent: Dec. 31, 1985

[54] METHOD OF FORMING IMAGE BY MEANS OF HEAT DEVELOPMENT

[75] Inventors: Shigeto Hirabayashi; Toyoaki Masukawa; Wataru Ishikawa, all of Hino, Japan

[73] Assignee: Konishiroku Photo Industry Co., Ltd., Tokyo, Japan

[21] Appl. No.: 633,063

[22] Filed: Jul. 20, 1984

Related U.S. Application Data

[63] Continuation of Ser. No. 400,928, Jul. 22, 1982, abandoned.

[30] Foreign Application Priority Data

Jul. 31, 1981 [JP] Japan ..... 56-121043

[51] Int. Cl.[4] ..... G03C 5/24

[52] U.S. Cl. ..... 430/353; 430/619; 430/620; 430/617; 430/618; 430/354; 430/961

[58] Field of Search ..... 430/619, 620, 617, 618, 430/961, 353, 354

[56] References Cited

U.S. PATENT DOCUMENTS

| | | | |
|---|---|---|---|
| 3,856,527 | 12/1974 | Hamb et al. | 430/353 |
| 3,933,508 | 1/1976 | Ohkubo et al. | 430/620 |
| 4,030,930 | 6/1977 | Sashihara et al. | 430/619 |
| 4,220,709 | 9/1980 | de Mauriac | 430/620 |
| 4,281,060 | 7/1981 | Usami et al. | 430/353 |

*Primary Examiner*—Won H. Louie

*Attorney, Agent, or Firm*—Jordan B. Bierman

[57] ABSTRACT

A method of forming an image by heat development of a photosensitive material comprising a support having a heat development photosensitive layer comprising imagewise exposing said layer and then bringing a non-water-permeable layer into close contact with said photosensitive layer, and heat developing said material, said photosensitive layer containing (a) an organic acid silver salt;

(b) a photosensitive silver halide;

(c) a reducing agent; and (d) a binder of at least one of gelatin and a gelatin derivative, said non-water-permeable layer comprising a high molecular compound selected from the group consisting of polyethylene, polypropylene, polystyrene, polyvinyl acetate, polyvinyl butyral, polyvinyl acetal, polyvinyl fluoride, polyvinyl pyrrolidone, polyvinyl chloride, polyacrylic ethyl, polymethacrylic methyl, polymethacrylic ethyl, polyvinylidene chloride, chlorinated polyethylene, chlorinated polypropylene, polycarbonate, polybutadiene, cellulose acetate, cellulose acetate butyrate, cellulose acetate propionate, ethylcellulose, benzyl cellulose, cellulose acetate phthalate, polyethylene terephthalate, fluorine-containing polymer and polyamide.

7 Claims, 2 Drawing Figures

METHOD OF FORMING IMAGE BY MEANS OF HEAT DEVELOPMENT

This application is a continuation of application Ser. No. 400,928, filed July 22, 1982, now abandoned, which claims priority of Japanese Application No. 121043/1981, filed July 31, 1981.

The present invention relates to an image forming process in which a heat development type photosensitive material is used, and more particularly to an image forming process using a heat development type photosensitive material which is high in both sensitivity and the maximum density and is also improved to be less in fogginess.

The conventional photographic processes using a silver halide which have so far been known are superior to other photographic process especially in photosensitiveness, gradation, image preservability and the properties of the like, and have most popularly been put to practical use.

In those processes, however, there uses a series of wet processes such as development and fixing with processing solutions and washing with water, so that there causes many problems that it takes time and labor to process and that phytotoxicity affects human body during the handling of chemicals and further that processing room, and operator's body and clothing are contaminated, and still further that environmental pollution is caused when a processing solution is discharged. With respect to photographic processes using a silver halide, it has so far been demanded to develop a photosensitive material and to establish an image forming process in both of which a dry process can be carried out without using any processing solution and to keep a processed image stable under an ordinary room lamp.

There have been a great number of proposals relating to the above-mentioned photographic dry processes, and inter alia, a heat development type photosensitive material capable of carrying out a developing process by a heat treatment has become the object of public attention as a very photosensitive material to meet the above-mentioned demands. As for said heat development type photosensitive materials, there has been disclosed a photosensitive material comprising an organic acid silver salt, a silver halide and a reducing agent as described in, for example, Japanese Patent Examined Publication Nos. 4921/1968 and 4924/1968 (hereinafter referred to as JPEP No.).

On the other hand, as for the developing apparatuses for a heat development type photosensitive material and the development processes thereof, a process to hold against a heat block for a certain period of time, a process to make travel along a heat block, a process to use a heat drum, a process to blow a blast of hot air and a process of the like, and besides, a development process to use an infra-red ray, an electric current or a microwave, are known as described in Japanese Patent Publication Open to Public Inspection (hereinafter referred to as Japanese Patent O.P.I. Publication) Nos. 158230/1979, 158231/1979, 2281/1980, 1939/1981 and 4904/1981, and Research Disclosure vol. 16810 and 17623.

In the publicity known image forming processes using a heat development type photosensitive material, however, it is not always possible to obtain a satisfactory photosensitivity and the maximum density of an image, and the problems still remain unsettled to put them to practical use.

Accordingly, it is an object of the invention to provide an image forming process in which there uses a heat development type photosensitive material that has a high sensitivity and the sufficient maximum density, and besides that an excellent image having less fogs may be obtained.

As the result from the various studies on the above-mentioned problems, the present inventors have found out to be attainable the aforesaid object through a method of forming image by means of heat development of a heat development type photosensitive material comprising a support having thereon a heat development photosensitive layer containing (a) an organic acid silver salt;

(b) a photosensitive silver halide;

(c) a reducing agent; and (d) gelatin and/or a gelatin derivative binder, comprising the steps of imagewisely exposing said layer and thereafter of bringing a non-water-permeable layer into close contact with said heat development photosensitive layer to make a heat development.

In other words, the facts of the finding are that a heat development type photosensitive material having the composition as stated above was exposed imagewise and was then brought into close contact with a non-water-permeable layer so as to prevent moisture from evaporating out of the photosensitive layer of said photosensitive material and a heat development was carried out in the state as it was, and thereby the developability of a heat development type photosensitive material in which gelatin and/or the derivatives thereof are served as the binder was remarkably accelerated, and the photographic characteristics thereof was also improved. The facts took the inventors who have taken part for many years in this field by surprise. The reason why such development as stated above was remarkably accelerated has not completely been made clear yet, however, it may probably be considered that the moisture was prevented from reducing from gelatin being heat-developed by a non-water-permeable layer was brought into close contact with the surface of a photosensitive layer and then by heat-developing it, and that the gelatin was softened by the moisture at the heat-development temperature to display the characteristics similar to that of a thermoplastic binder and thereby the development was so accelerated remarkably.

As for the amount of water necessary for endowing gelatin with such characteristics as above, it is sufficient to be an equilibrium moisture content that gelatin and said photosensitive material contain under the conditions of the relative humidity of 20–100%, and the sharp increases of the sensitivity and the maximum density thereof cannot be expected until the moisture is prevented from reducing such as evaporating in a heat development.

The following is the detailed description of the invention.

The image forming processes of the invention are those in which the aforesaid heat development type photosensitive material is exposed imagewisely and a non-water-permeable layer is then brought into close contact with the surface of the heat development type photosensitive material to carry out a heat development. The concrete processes thereof may be roughly classified into the following two processes:

1. A process in which a sheet of material comprising a non-water-permeable substance or a sheet of material having a non-water-permeable layer such as a resin-coated paper is laid in advance on the surface of the photosensitive layer of a heat development type photosensitive material before the development is carried out and a heat development thereof is then carried out while keeping the close contact with each other.

As for the concrete examples of substances to be served as a non-water-permeable layer, there can be given a high molecular compound such as polyethylene, polypropylene, polystyrene, polyvinyl acetate, polyvinyl butyral, polyvinyl acetal, polyvinyl fluoride, polyvinyl pyrrolidone, polyvinyl chloride, polyacrylic ethyl, polymethacrylic methyl, polymethacrylic ethyl, polyvinylidene chloride, chlorinated polyethylene, chlorinated polypropylene, polycarbonate, polybutadiene, cellulose acetate, cellulose acetate butylate, cellulose acetate propionate, ethyl cellulose, benzyl cellulose, cellulose acetate phthalate, polyethylene terephthalate, or fluorine-contained polymer (ex. polytetrafluoroethylene) or polyamide.

A non-water-permeable layer comprising said non-water-permeable substance may be peeled off after a heat development is completed or may be applied to use as it is without peeling off.

2. A process in which a non-water-permeable layer is arranged inside a heat development means and the surface of a heat development type photosensitive layer is brought into close contact with said non-water-permeable layer and thus a development is carried out while keeping the close contact with each other.

The process is that the area keeping in contact with the surface of a heat development type photosensitive layer is made non-water-permeable inside the heat development means, and as for one of the examples of said means, there is given a heat drum type heat development means as shown in FIG. 1 attached hereto, wherein the drum surface is formed of a non-water-permeable substance.

BRIEF DESCRIPTION OF THE DRAWING

FIG. 2 illustrates the sectional view of the apparatus of the above embodied by the other example, wherein,

Figure 1:
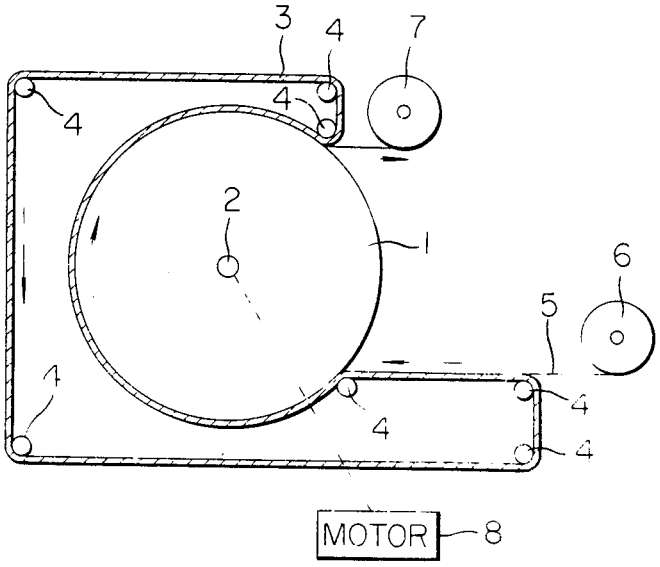
FIG. 1 illustrates the sectional view of a heat drum type heat development apparatus to be used in the processes of the invention.

1 . . . Heat drum formed by coating on the surface thereof with a non-water-permeable substance,

5 . . . Heat development type photosensitive material, and,

10 . . . Cover for a non-water-permeable substance.

In the drawing, reference numeral 1 designates a heat drum formed by coating on the surface thereof with a non-water-permeable substance. As for the examples of said non-water-permeable substances, there can be given a single substance of metal such as iron, nickel, chrome, copper, aluminium, titanium and the like and the alloys thereof, glass, polystyrene, polyethylene, polycarbonate, polyethylene terephthalate and the like; 2 is a rotary shaft; 3 is a belt tensionwise suspended to come into pressure contact with the surface of a heat drum; 4 is a support roller for tensionwise suspending said belt 3; 5 is a heat development type photosensitive material; 6 is a reel for supplying said photosensitive material 5; 7 is a reel for taking up said photosensitive material 5; and 8 is a motor for revolving said heat drum 1.

In the developing means, an exposed heat development type photosensitive material 5 is conveyed from supply reel 6 along belt 3 in the direction of the arrow and is then heat-developed while keeping a non-water-permeable layer formed on the surface of heat drum 1 in contact with the surface of the photosensitive layer, and thus, the photosensitive material 5 which is completed the development is taken up by the take-up reel 7.

Figure 2:
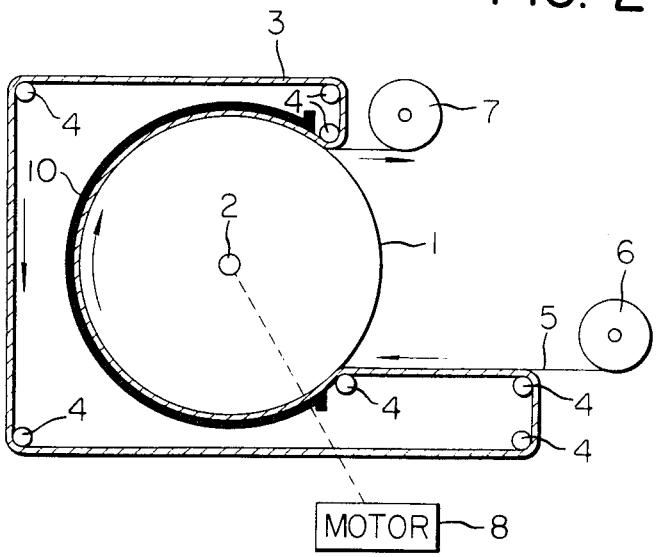

FIG. 2 illustrates the other example of the aforesaid development means that has further been improved to be suitable for heat-developing to bring non-water-permeable layers into close contact at the same time with the both surfaces of a heat development type photosensitive material, respectively.

In the drawing, the description of the reference numerals identical to those given in FIG. 1 are omitted. The numeral 10 is a cover comprising a non-water-permeable substance and is so constituted as to cover the face of the belt 3 opposite to the side facing the heat drum 1.

In using the development means, when heat development type photosensitive material 5 is heatedly developed by means of heat drum 1, the surface of the photosensitive drum is coated with a non-water-permeable layer formed on the surface of heat drum 1 and at the same time the rear face thereof is covered by cover 10 of non-water-permeable substance suspended tensionwise through belt 3 so as to prevent the moisture at maximum from reducing, and therefore, the use of the development means is more effective to try for accelerating a development.

Next, in the image forming processes of the invention, as for the organic acid silver salts to be used in a heat development type photosensitive material, the examples are given, as described in JPEP Nos. 4921/1968, 26582/1969, 18416/1970, 12700/1970 and 22185/1970; Japanese Patent O.P.I. Publication Nos. 52626/1974, 31728/1977, 137321/1977, 141222/1977, 36224/1978 and 37610/1978; and U.S. Pat. Nos. 3,330,633, 3,794,496, 4,105,451, 4,123,274 and 4,168,980; a silver salt of a aliphatic carboxylic acid such as silver laurate, silver myristate, silver palmitate, silver stearate, silver arachidonate, silver behenate, silver-α-(1-phenyltetrazole thio)acelate; a silver salt of an aromatic carboxylic acid such as silver benzoate and silver phthalate; a silver salt of an organic compound having an imino group such as silver salt of benzotriazole, saccharin, phthalodinon, or phthalimide; a silver salt of a compound having a mercapto or thion group such as silver salt of mercaptobenzoxazole, mercaptoxadiazole, 2-mercaptobenzothiazole, 2-mercaptobenzoimidazole or 3-mercapto-4-phenyl-1,2,4-triazole; and besides, silver salt of 4-hydroxy-6-methyl-1,3,3a,7-tetrazaindene or 5-methyl-7-hydroxy-1,2,3,4,6-benzozaindene.

Among the above given organic acid silver salts, a silver salt of an aliphatic carboxylic acid is preferable, and a silver salt of a long chained aliphatic carboxylic acid having 18–33 carbon atoms is more particularly preferable.

In an image forming process of the invention, as for a silver halide to be used in a heat development type photosensitive material, the examples thereof can be given silver chloride, silver bromide, silver iodide, silver chlorobromide, silver chloroiodide, silver iodobromide, silver chloroiodidobromide and the like. Said photosensitive silver halide can be prepared in an arbitrary process such as a single-jet process, a double-jet process or the like which have publicly been known in the photographic technical field, and in the invention in particular, a preferable effect can be attained by making use of a gelatin-silver halide emulsion prepared in accordance with such a method or technique including those for preparing a gelatin-silver halide photographic emulsion.

Said photosensitive silver halide may also be allowed to chemically sensitize in an arbitrary process that has publicly been known in the technical field of photography. As for the sensitization processes, the examples are given a gold sensitization, a sulfuric sensitization, a gold-sulfur sensitization, a reduction sensitization and the like.

Said photosensitive silver halide may be allowed to be of the coarse-grained or the fine-grained, and inter alia, the preferable grain sizes of the longitudinal diameter are between 1.5–0.001 microns, approximately, and more preferably between 0.5–0.05 microns, approximately.

A photosensitive silver halide emulsion thus prepared may be applied to a layer containing photosensitive silver halide that is a constitutional layer of said photosensitive material prepared in accordance with the invention.

Further, as for other processes for preparing a photosensitive silver halide, a photosensitive silver halide may be formed in a portion of an organic acid silver salt by making a component for forming a photosensitive silver salt co-exist therewith. As for the components for forming a photosensitive silver salt to be used in said preparation process, there can be given, for example, an inorganic halogenide as represented by MXn, wherein M represents an H atom, $NH_4$ group and a metallic atom group; X represents a Cl, Br and I atom; n has a value of one in the case that M represents an H atom and $NH_4$ group, or has a valence of a metallic atom in the case that M represents said metallic atom. As for the metallic atoms, there are given those of lithium, sodium, potassium, rubidium, caesium, copper, gold, beryllium, magnesium, calcium, strontium, barium, zinc, cadmium, mercury, aluminium, indium, lanthanum, ruthenium, thallium, germanium, tin, lead, antimony, bismuth, chrome, molybdenum, tungsten, manganese, rhenium, iron, cobalt, nickel, rhodium, palladium, osmium, iridium, platinum, cerium and the like; a halogen containing metallic complex such as $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$ and the like; an onium halide, for example, a quaternary ammonium halide such as tetramethyl ammonium bromide, trimethylphenyl ammonium bromide, cetyl ethyl dimethyl ammonium bromide, 3-methyl thiazolium bromide and trimethyl benzyl ammonium bromide; a quaternary phosphonium halide such as tetraethyl phosphonium bromide; a tertiary sulfonium halide such as benzyl ethyl methyl bromide and 1-ethy thiazolium bromide; a halogenated hydrocarbon such as iodoform, bromoform, carbon tetrabromide and 2-brome-2-methyl propane; a N-halogenide such as N-chlorosuccinimide, N-bromosuccinimide, N-bromophthalimide, N-bromacetamide, N-iodosuccinimide, N-bromophthaladinone, N-chlorophthaladinone, N-bromacetanilide, N,N-dibromobenzene sulfonamide, N-bromo-N-methyl benzene sulfonamide and 1,3-dibromo-4,4-dimethyl hydantoin; and other halogenide such as triphenyl methyl chloride, triphenyl methyl bromide-2-bromobutyric acid and 2-bromethanol.

Said photosensitive silver halide and said components for forming a photosensitive silver salt may be used combinably in a variety of processes, and the amount used thereof is 0.001–1.0 mol to one mol of an organic acid silver salt and more preferably 0.01–0.3 mol thereto.

In the image forming processes of the invention, as for the reducing agents to be used in a heat development type photosensitive material, there can be given, for example, a phenol such as p-phenylphenol, p-methoxy phenol, 2,6-di-tert-butyl-p-cresol and N-methyl-p-aminophenol; a sulfonamide phenol such as 4-benzene sulfonamide phenol, 2-benzensulfonamide phenol, 2,6-dichloro-4-benzenesulfonamide phenol and 2,6-dibromo-4-(p-toluene sulfonamide)phenol; a di- or polyhydroxy benzene such as hydroquinone, tert-butyl hydroquinone, 2,6-dimethyl hydroquinone, chlorohydroquinone, carboxy hydroquinone, catechol and 3-carboxy catechol; a naphthol such as $\alpha$-naphthol, $\beta$-naphthol, 4-aminonaphthol and 4-methoxynaphthol; a hydroxy binaphthyl and a methylene bisnaphthol such as 1,1′-dihydroxy-2,2′-binaphthyl, 6,6′-dibromo-2,2′-dihydroxy-1,1′-binaphthyl, 6,6′-dinitro-2,2′-dihydroxy-1,1′-binaphthyl, 4,4′-dimethoxy-1,1′-dihydroxy-2,2′-binaphthyl and bis(2-hydroxy-1-naphthyl)methane; a methylene bisphenol such as 1,1-bis(2-hydroxy-3,5-dimethylphenyl)-3,5,5-trimethyl hexane, 1,1-bis(2-hydroxy-3-tert-butyl-5-methyl phenyl)methane, 1,1-bis(2-hydroxy-3,5-di-tert-butyl phenyl)methane, 2,6-methylene bis(2-hydroxy-3-tert-butyl-5-methyl phenyl)-4-methyl phenol, $\alpha$-phenyl-$\alpha$,$\alpha$-bis(2-hydroxy-3,5-di-tert-butyl phenyl)methane, $\alpha$-phenyl-$\alpha$,$\alpha$-bis(2-hydroxy-3-tert-butyl-5-methyl phenyl)methane, 1,1-bis(2-hydroxy-3,5-dimethyl phenyl)-2-methyl propane, 1,1,5,5-tetrakis(2-hydroxy-3,5-dimethyl phenyl)-2,4-ethyl pentane, 2,2-bis(4-hydroxy-3,5-dimethyl phenyl)propane, 2,2-bis(4-hydroxy-3-methyl-5-tert-butyl phenyl)propane and 2,2-bis(4-hydroxy-3,5-di-tert-butyl phenyl)propane; ascorbic acid; a 3-pyrazolidone, a pyrazoline; a pyrazolone; a hydrazone; and a paraphenylene diamine.

In the case of using a hydrazine and paraphenylendiamine to serve as a reducing agent, a color image is obtained by combinedly making use of a phenol or naphthol compound and a compound having an activated methylene such as pyrazolone, pyrazolotriazole, indazole, pyrazolobenzimidazole and pyrazoline, as described in U.S. Pat. Nos. 3,531,286 and 3,764,328, and Japanese Patent O.P.I. Publication No. 27132/1981. The aforesaid reducing agents may be used independently or in combination with two or more kinds thereof. The amount used depends upon what kind of the organic acid silver salts, for example, other additives such as a color toning agent, and it is normally 0.05–10 mol to mol of an organic acid silver salt and more preferably 0.1–3 mol thereto.

In the invention, the binders to be used in a heat development type photosensitive material comprise substantially gelatin and/or the derivatives thereof. It is preferable that said binders are composed of gelatin and/or the derivatives thereof and besides it will also do no harm to contain a water-soluble binder other than gelatin and/or the derivatives thereof such as polyvinyl alcohol, polyacrylamide and carboxymethyl cellulose provided that such a binder does not interfere the effects of the invention, and the embodiments thereof shall be included in the invention.

The examples of the binders for a heat development type photosensitive material in which gelatin is used have been described in U.S. Pat. No. 4,168,980, and Japanese Patent O.P.I. Publication Nos. 52626/1974 and 116144/1978, and JPEP Nos. 26582/1969, 12700/1970 and 18416/1970. In a heat development type photosensitive material in which gelatin is served as the binder, it becomes possible to use a highly sensitive gelatin-silver halide emulsion in which the photosensitive silver halide is increased in sensitivity through a variety of processes, and therefore, the extremely higher sensitivity can be obtained in comparison with the case of using the other types of a non-water-soluble binder, and it is also possible to prevent said photosensitive material from blackening caused by printing-out an unexposed area after processing, because an unexposed silver halide can be removed in a fixing step with an ordinary type of fixing solution after a heat development. And, in the case of using in a color photosensitive material, there displays such a merit as that a bleach and a bleach-fix can easily be carried out, and on the other hand there has been such a demerit as that the developments are extremely hard to proceed in comparison with the case of using the other types of a thermoplastic binder, because gelatin is not a thermoplastic binder, so that there does not bring about a binder softening that accelerates the development at a heat development temperature.

However, according to the aforesaid process of the invention, the merit of using gelatin and/or the derivatives thereof (that is, the maximum density and the sensitivity thereof are high) to serve as a binder is fully enjoyed, so that there is nothing to interfere the progress of a development as described above.

In the case that gelatin and/or the derivatives thereof is used as a binder and that the aforesaid organic acid silver salt is dispersed in the said binder, water is used as the solvent and it is preferable to use water of 50% or less by weight in combination with an organic solvent capable of mixing, in order to improve the dispersability.

As for the organic solvents for the purpose, there are given, for example, a lower alcohol such as methanol, ethanol, isopropanol and n-propanol; acetone; methyl ethyl ketone, ethylene glycol, propylene glycol, glycerol, ethylene glycol monoethyl ether, ethylene glycol monoethyl ether and dioxane.

A surface active agent is also effective to use in order to improve the dispersibility. As for the surface active agents, any type of anionic, cationic, anphoteric and nonionic surface active agents may be used, and inter alia, the anionic surface active agents such as alkylbenzene sulfonate and alkylnaphthalene sulfonate are preferable, in particular. The amount used thereof is 0.01% by weight up to 10.0% by weight to the amount of an organic acid silver salt, and more preferably 0.1% by weight to 5.0% by weight thereto.

To a heat development type photosensitive material of the invention, a color toning agent can be applied with the purpose of blackening an image.

As for the color toning agents, there can be given, for example, such a compound as phthalimide, pyrazolone, quinazolinone, N-hydroxy naphthalimide, benzoxazine, naphthoxazine, 2,3-dihydro-phthalazinedione, 2,3-dihydro-1,3-oxazine-2,4-dione, oxypyridine, aminopyridine, hydroxyquinoline, aminoquinoline, isocarbostyryl, sulfonamide, 2H-1,3-benzothiazine-2,4-(3H)-dione, benzotriazine, mercaptotriazole, dimercaptotetrazapentalene, phthalic acid, naphthalic acid aminophthalic acid, or phthalazinone, and the derivatives thereof, as described in Japanese Patent O.P.I. Publication Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980 and 32015/1980; West German Pat. Nos. 2,140,416, 2,147,063 and 2,220,618; and U.S. Pat. Nos. 3,080,254, 3,847,612, 3,782,941, 3,994,732, 4,123,282 and 4,201,582.

An anti-foggant may also be applied to a heat development type photosensitive material of the invention.

As for the anti-foggants, there are given, for example, such a compound as a mercuric salt; an oxidation agent such as an N-halogenacetamide, an N-halogenosuccinimide, perchloric acid and the salts thereof, an inorganic peroxide and a persulfate; an acid and the salts thereof such as sulfinic acid, lithium laurate, rosin, diterpenic acid and thiosulfonic acid; a sulfur containing compound such as a mercaptol-releasable compound, thiourcil, disulfide, a simple substance of sulfur, mercapto-1,2,4-triazole, thiazolinethione and a polysulfide compound; and besides, oxazoline or a compound such as 1,2,4-triazole or phthalimide; as stated in JPEP No. 11113/1972; Japanese Patent O.P.I. Nos. 90118/1974, 10724/1974, 97613/1974, 101019/1975, 130720/1974, 123331/1975, 47419/1976, 57435/1976, 78227/1976, 104338/1976, 19825/1978, 20923/1978, 50725/1976, 3223/1976, 42529/1976, 81124/1976, 51821/1979 and 93149/1980; British Pat. No. 1,455,271; U.S. Pat. Nos. 3,885,968, 3,700,457, 4,137,079 and 4,138,265; and West German Pat. No. 2,617,907.

It is allowed to apply to a heat development type photosensitive material of the invention, as occasion demands, besides the above-given components, arbitrarily with a variety of the publicly known additives such as a water-holding compound, a spectral sensitization dye, an anti-halation dye, a print-out preventive or a non-mercuric anti-foggant.

As for the water-holding compounds, there are given, for example, hydroxyethyl cellulose, carboxymethyl cellulose, polyalkylene oxide (i.e.; polyglycol), an organic acid and the like.

As for the spectral sensitization dyes, there are used some kind thereof that is effective to a silver halide emulsion, for example, cyanine, merocyanine, rhodacyanine and a styryl are given.

Further, as for the print-out preventives, there are given, for example, tetrabromobutane, tribromoethanol, 2-bromo-2-tolylacetamide, 2-bromo-2-trisulfonylacetamide, 2-tribromomethyl sulfonyl benzothiazole, 2,4-bis(tribromomethyl)-6-methyl triazine, and the like.

Next, as for the supports to be used in the heat development type photosensitive materials of the invention, there are given, for example, a synthetic plastic-films such as a polyethylene film, a cellulose acetate film and a polyethylene terephthalate film and a sheet of paper such as a master paper for photographic use, a printing paper, a baryta paper, a resin coated paper or the like.

The above-mentioned composites are coated over said support together with a binder and a suitable solvent. The thickness of the coating is 1–1000$\mu$, and more preferably 3–20$\mu$, after dried up.

It is also allowable to form a superposing layer on a heat development type photosensitive layer as occasion demands.

A heat development type photosensitive material thus prepared is exposed imagewise as it is to serve as a photosensitive material and then developed only by heating for 1–60 seconds within the range of temperature between 80°–200° C., normally.

It may also be allowed to apply a preliminary heating at the temperature range of 70°–180° C. before an exposure is made, if necessary.

As for the light source suitable for an image exposure, there are given a tungsten lamp, a fluorescent lamp, a mercury lamp, an iodine lamp, a xenon lamp, a CRT light source, a laser beam source and the like.

The following is the further concreted description of the invention with reference to the examples:

EXAMPLE 1

The solution in which 54.4 g of behenic acid were dissolved in 1200 ml of toluene, was added with 2400 ml of water and the aqueous solution thus obtained was homogenized by means of a high-speed homogenizer. Ammoniacal silver nitrate solution of 400 ml containing 27.2 g of silver nitrate were dropped into said solution, taking 30 minutes with keeping the temperature of the reacting solution at 60° C. under agitation and the further agitation was applied thereto for another 30 minutes, and then the crystals thus produced were filtrated, washed, cleaned with methanol and dried up under reduced pressure in succession, and thus 65.0 g of silver behenate were obtained.

The dispersed solution was prepared in the process that 200 ml of ethanol, 100 ml of 10% aqueous gelatin solution, 100 ml of water and 8 ml of 10% aqueous solution of Alkanol B (alkyl naphthalene sulfonate, mfd. by DuPont) were added into 9.0 g (0.02 mol, approx.) of the silver behenate thus obtained and the ultrasonic wave dispersion was applied thereto. The coating solution was prepared by adding the following components in order with agitating said dispersing solution.

[(Components)]

(1) Phthalazinone (Methanol solution of 5%, by weight) of 20 ml.

(2) Mercuric acetate (Methanol solution of 1%, by weight) of 10 ml.

(3) Silver bromide Emulsion (Cubical emulsion having the average grain diameter of 0.2 microns containing 60 g of gelatin and 0.353 mol of silver per kg. of the emulsion) of 9 ml.

(4) Sensitization dye (Methanol solution of 0.05%, by weight, of merocyanine dye formularized below) of 2.5 mol.

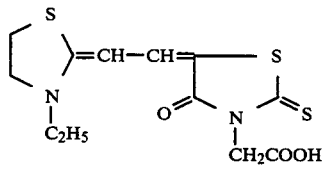

(5) Hydroquinone (Methanol solution of 5%, by weight) of 25 ml.

The heat development type photosensitive material (A) was thus prepared by coating the coating solution prepared as above on to a sheet of raw paper for photographic use so that the amount of silver can be 0.5 g per $m^2$.

The heat development type photosensitive material (A) thus prepared was exposed imagewise to white light through a stepwedge. The quantity of the exposure applied was 1600 CMS (i.e., candela·meter·second).

Next, Sample-1 was prepared in the process that a polyethylene terephthalate sheet of 50μ in thickness was superposed on the surface of the heat development type photosensitive layer of thus exposed heat development type photosensitive material (A) and the heat was applied at 110° C. for ten seconds, and thus the development was carried out. And, for the purpose of controlling, Sample-2 was prepared in the process that thus exposed heat development type photosensitive material (A) was heated as it was at 110° C. for ten seconds and the development was then carried out. The results observed therefrom are indicated in Table 1.

TABLE 1

| | Maximum Density | Minimum Density | Relative Sensitivity |
|---|---|---|---|
| Sample-1 (The invention) | 1.65 | 0.20 | 840 |
| Sample-2 (For the Control) | 0.65 | 0.15 | 100 |

In the table, the relative sensitivity indicates the sensitivity relative to the sensitivity, taking the value of 100, of Sample-2 which was developed without superposing any non-water-permeable layer thereon.

From the results, it can be found that the sample prepared in an image forming process of the invention was obviously excellent in the maximum density and also in the sensitivity in comparison with the control sample.

EXAMPLE 2

Silver salt of benzotriazole of 11.9 g were dissolved in 100 ml of methanol and the solution thus obtained was dropped into the solution in which 16.9 g of silver nitrate were dissolved in 200 ml of water, by spending five minutes.

The crystals thus produced were filtrated, washed and further cleaned with methanol, and then dried up under reduced pressure, and thus 21.0 g of silver salt of benzotriazole were obtained. Thus obtained silver salt of benzotriazole of 4.5 g (0.02 mol, approx.) were added with 100 ml of 10% gelatin solution, 100 ml of water, and 4 mol of 10% aqueous solution of Alkanol B (i.e.; alkylnaphthalene sulfonate, mfd. by DuPont) and the dispersant solution was prepared in ultrasonic-wave dispersion process.

The coating solution was then prepared by adding the following components in succession with agitation.

[Components]

(1) Phthalazinone (Methanol solution of 5%, by weight) of 20 ml.

(2) mercuric acetate (Methanol solution of 1%, by weight) of 5 ml.

(3) Silver bromide emulsion (Cubical emulsion having the average grain diameter of 0.2 microns containing 60 g of gelatin and 0.353 mol of silver per kg of the emulsion) of 9 ml.

(4) Sensitization dye (Methanol solution of 0.05%, by weight, of merocyanine dye formularized below) of 2.5 ml.

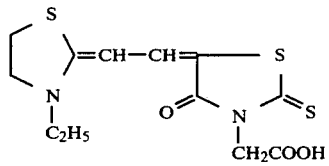

(5) Hydroquinone (Methanol solution of 5%, by weight) of 25 ml.

The heat development type photosensitive material (B) was thus prepared by coating the coating solution prepared as above on to a sheet of raw paper for photographic use so that the amount of silver can be 0.6 g per $m^2$.

The heat development type photosensitive material (B) thus prepared was exposed imagewise to white light through a stepwedge. The quantity of the exposure applied was 1600 CMS (i.e., candela·meter·second).

Next, Sample-3 was prepared in the process that a triacetyl cellulose sheet of 50μ in thickness was superposed on the surface of the heat development type photosensitive layer of thus exposed heat development type photosensitive material (B) and the heat was applied at 120° C. for ten seconds, and thus the development was carried out. And, for the purpose of controlling, Sample-4 was prepared in the process that thus exposed heat development type photosensitive material (B) was heated as it was at 120° C. for ten seconds and the development was then carried out. The results observed therefrom are indicated in Table 2.

TABLE 2

| | Maximum Density | Minimum Density | Relative Sensitivity |
|---|---|---|---|
| Sample-3 (The Invention) | 1.08 | 0.10 | 340 |
| Sample-4 (For the Control) | 0.42 | 0.09 | 100 |

In the table, the relative sensitivity indicates the sensitivity relative to the sensitivity, taking the value of 100, of Sample-4 which was developed without superposing any non-water-permeable layer thereon.

From the results, it can be found that the sample prepared in an image forming process of the invention was obviously excellent in the maximum density and also in the sensitivity in comparison with the control sample.

EXAMPLE 3

The heat development type photosensitive material (A) and (B) were exposed imagewise to white light through the stepwedges, respectively. Each of the quantity of the exposure applied was 1600 CMS (i.e., candela·meter·second). Next, the surface of the heat development type photosensitive layer of the photosensitive material (A) was heated at 110° C. and that of the material (B) at 120° C. for ten seconds respectively with bringing them into close contact with the heat drum of a heat drum type heat development apparatus used therein, as shown in FIG. 1, and the developments were carried out, and thus Sample-5 and Sample-6 were prepared, respectively. As for the drum coated with a non-water-permeable substance shown in FIG. 1, there used a drum of which an iron plate was chrome-plated and a fabric belt to serve as the belt used.

As for the control tests, Sample-7 and Sample-8 were prepared in the similar process to those taken to prepare the photosensitive materials (A) and (B), except that the photosensitive materials (A) and (B) were turned over so as to make each of the surface of the photosensitive layers opposite to the side of the heat drum and the developments were then carried out respectively. The results therefrom were shown in Table 3 and Table 4, respectively.

TABLE 3

| | Maximum Density | Minimum Density | Relative Sensitivity |
|---|---|---|---|
| Sample-5 (The Invention) | 1.62 | 0.20 | 880 |
| Sample-7 (For the Control) | 0.65 | 0.15 | 100 |

TABLE 4

| | Maximum Density | Minimum Density | Relative Sensitivity |
|---|---|---|---|
| Sample-6 (The Invention) | 1.12 | 0.10 | 380 |
| Sample-8 (For the Control) | 0.42 | 0.09 | 100 |

The relative sensitivity indicated in the above tables is the relative sensitivity taken the sensitivity of Sample-7 and Sample-8 to regard as the value of 100 when the samples were developed without bringing the surfaces of the heat development type photosensitive layers thereof into close contact with the heat drum coated with a non-water-permeable substance. From the above results, it can be found that the samples prepared in an image forming process of the invention are obviously excellent both in the maximum density and the sensitivity in comparison with the control samples.

What is claimed is:

1. A method of forming an image by heat development of a heat developable photosensitive material comprising a support and a heat developable photosensitive layer thereon comprising imagewise exposing said photosensitive layer, then bringing a non-water-permeable layer into close contact with said photosensitive layer, and heat developing said photosensitive layer, said photosensitive layer comprising (a) an organic acid silver salt;
(b) a photosensitive silver halide;
(c) a reducing agent; and
(d) a binder containing at least one of gelatin and a gelatin derivative;

said non-water-permeable layer comprising a high molecular compound selected from the group consisting of polyethylene, polypropylene, polystyrene, polyvinyl acetate, polyvinyl butyral, polyvinyl acetal, polyvinyl fluoride, polyvinyl pyrrolidone, polyvinyl chloride, polyacrylic ethyl, polymethacrylic methyl, polymethacrylic ethyl, polyvinylidene chloride, chlorinated polyethylene, chlorinated polypropylene, polycarbonate, polybutadiene, cellulose acetate, cellulose acetate butyrate, cellulose acetate propionate, ethyl cellulose, benzyl cellulose, cellulose acetate phthalate, polyethylene terephthalate, fluorine-containing polymer, and polyamide.

2. A method according to claim 1, wherein the heat development is performed during said close contacting.

3. A method according to claim 1, wherein the heat development is performed after said close contacting.

4. A method according to claim 1, wherein the non-water-permeable layer is provided on the surface of a heat drum.

5. A method according to claim 1, wherein the non-water-permeable layer is brought into close contact with both surfaces of the photosensitive material.

6. A method of forming an image by heat development of a heat developable photosensitive material comprising a support and a heat developable photosensitive layer thereon comprising imagewise exposing said photosensitive layer, then bringing a non-water-permeable layer into close contact with said photosensitive layer, and heat developing said photosensitive layer, said photosensitive layer comprising (a) an organic acid silver salt;
(b) a photosensitive silver halide;
(c) a reducing agent; and
(d) a binder containing at least one of gelatin and a gelatin derivative;

said non-water-permeable layer consists essentially of a high molecular compound selected from the group consisting of polyethylene, polypropylene, polystyrene, polyvinyl acetate, polyvinyl butyral, polyvinyl acetal, polyvinyl fluoride, polyvinyl pyrrolidone, polyvinyl chloride, polyacrylic ethyl, polymethacrylic methyl, polymethacrylic ethyl, polyvinylidene chloride, chlorinated polyethylene, chlorinated polypropylene, polycarbonate, polybutadiene, cellulose acetate, cellulose acetate butyrate, cellulose acetate propionate, ethyl cellulose, benzyl cellulose, cellulose acetate phthalate, polyethylene terephthalate, fluorine-containing polymer, and polyamide.

7. A method of forming an image by heat development of a heat developable photosensitive material comprising a support and a heat developable photosensitive layer thereon comprising imagewise exposing said photosensitive layer, then bringing a non-water-permeable layer into close contact with said photosensitive layer, and heat developing said photosensitive layer, said photosensitive layer comprising (a) an organic acid silver salt;
(b) a photosensitive silver halide;
(c) a reducing agent; and
(d) a binder containing at least one of gelatin and a gelatin derivative;

said non-water-permeable layer consisting of a high molecular compound selected from the group consisting of polyethylene, polypropylene, polystyrene, polyvinyl acetate, polyvinyl butyral, polyvinyl acetal, polyvinyl fluoride, polyvinyl pyrrolidone, polyvinyl chloride, polyacrylic ethyl, polymethacrylic methyl, polymethacrylic ethyl, polyvinylidene chloride, chlorinated polyethylene, chlorinated polypropylene, polycarbonate, polybutadiene, cellulose acetate, cellulose acetate butyrate, cellulose acetate propionate, ethyl cellulose, benzyl cellulose, cellulose acetate phthalate, polylethylene terephthalate, fluorine-containing polymer, and polyamide.

* * * * *